US008098271B2

(12) United States Patent
Tsuchiya

(10) Patent No.: US 8,098,271 B2
(45) Date of Patent: Jan. 17, 2012

(54) EXPOSURE DEVICE, LIGHT-EMITTING DEVICE, IMAGE FORMING APPARATUS AND FAILURE DIAGNOSING METHOD

(75) Inventor: Ken Tsuchiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 478 days.

(21) Appl. No.: 12/368,390

(22) Filed: Feb. 10, 2009

(65) Prior Publication Data

US 2010/0045763 A1 Feb. 25, 2010

(30) Foreign Application Priority Data

Aug. 22, 2008 (JP) ..... 2008-214548

(51) Int. Cl.
*B41J 2/45* (2006.01)

(52) U.S. Cl. ..... 347/238

(58) Field of Classification Search ..... 347/238
See application file for complete search history.

(56) References Cited

U.S. PATENT DOCUMENTS 5,973,719 A * 10/1999 Araki et al. ..... 347/253
7,944,489 B2 * 5/2011 Segami et al. ..... 348/249
2010/0157011 A1 * 6/2010 Ohno ..... 347/224
2011/0018958 A1 * 1/2011 Ohno et al. ..... 347/224
2011/0058009 A1 * 3/2011 Ohno ..... 347/224

FOREIGN PATENT DOCUMENTS

JP 2006-088437 4/2006
JP 2007-125785 5/2007
JP 2008-284819 11/2008

* cited by examiner

*Primary Examiner* — Charlie Peng
(74) *Attorney, Agent, or Firm* — Fildes & Outland, P.C.

(57) ABSTRACT

The exposure device includes: a light output device outputting light for exposing a charged image carrier, and including light-emitting elements caused to emit light or not through a control using a light-emission signal, switch elements provided corresponding to the light-emitting elements, and sequentially turned on to set the light-emitting elements ready to emit light, a transfer-signal generating unit generating a transfer signal for sequentially turning on the switch elements, a light-emission signal supply unit supplying the light-emission signal to the light-emitting elements, and a detection unit causing the transfer-signal generating unit to generate a transfer signal having cycles whose number is larger than that of the light-emitting elements, and detecting a potential of an output region of the light-emission signal supply unit while making an output from the light-emission signal supply unit high impedance; and an optical member focusing light outputted by the light output device onto the image carrier.

11 Claims, 8 Drawing Sheets

FIG.8A ID_ia
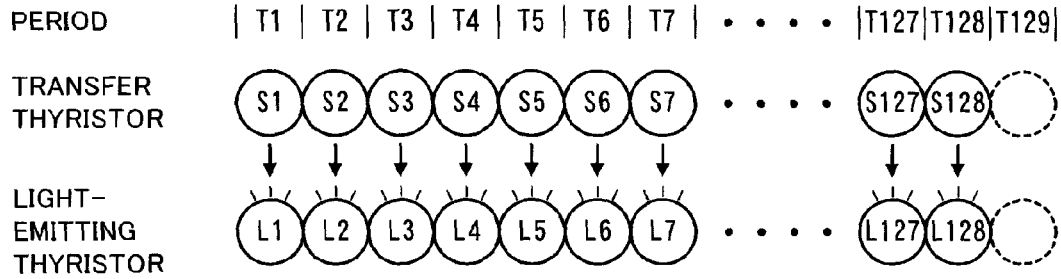
FIG.8B ID_ib
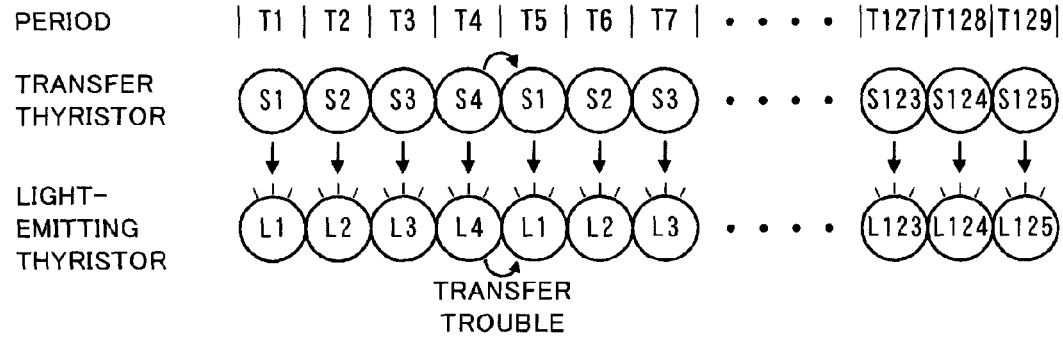
FIG.8C ID_ic
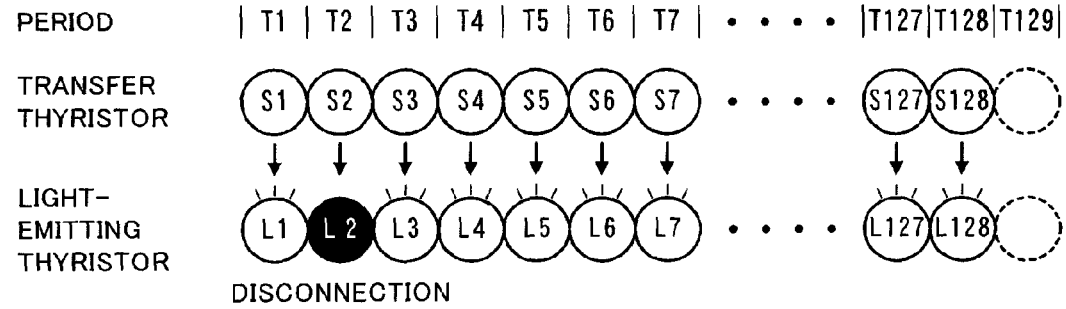

EXPOSURE DEVICE, LIGHT-EMITTING DEVICE, IMAGE FORMING APPARATUS AND FAILURE DIAGNOSING METHOD

CROSS REFERENCE TO RELATED APPLICATIONS

This application is based on and claims priority under 35 USC §119 from Japanese Patent Application No. 2008-214548 filed Aug. 22, 2008.

BACKGROUND

1. Technical Field

The present invention relates to an exposure device including multiple light-emitting elements, a light-emitting device, an image forming apparatus and a failure diagnosing method.

2. Related Art

Recently, the following type of an exposure device that exposes the outer surface of an image carrier such as a photoconductive drum has been employed in an electrophotographic image forming apparatus such as a printer or a copy machine. The exposure device includes a light-emitting element array having light-emitting elements, such as light emitting diodes (LEDs), arrayed in a line.

SUMMARY

According to an aspect of the invention, there is provided an exposure device including: a light output device that outputs light for exposing a charged image carrier, the light output device including: plural light-emitting elements caused to emit light or not to emit light through a control using a light-emission signal; plural switch elements provided respectively corresponding to the plural light-emitting elements, the switch elements being sequentially turned on to set the respective light-emitting elements ready to emit light; a transfer signal generating unit that generates a transfer signal for sequentially turning on the plural switch elements; a light-emission signal supply unit that supplies the light-emission signal to the plural light-emitting elements; and a detection unit that causes the transfer signal generating unit to generate a transfer signal having plural cycles whose number is larger than the number of the plural light-emitting elements, and that detects an electric potential of an output region of the light-emission signal supply unit while making an output from the light-emission signal supply unit high impedance; and an optical member that focuses light outputted by the light output device onto the image carrier.

BRIEF DESCRIPTION OF THE DRAWINGS

Exemplary embodiment(s) of the present invention will be described in detail based on the following figures, wherein:

FIGS. 8A to 8C shows relations among the 1st to 129th periods, the transfer thyristors turned on in the respective periods, and the light-emitting thyristors set ready to emit light by the respective turned-on transfer thyristors.

DETAILED DESCRIPTION

Hereinafter, a detailed description will be given of exemplary embodiments of the present invention with reference to the accompanying drawings.

Figure 1:
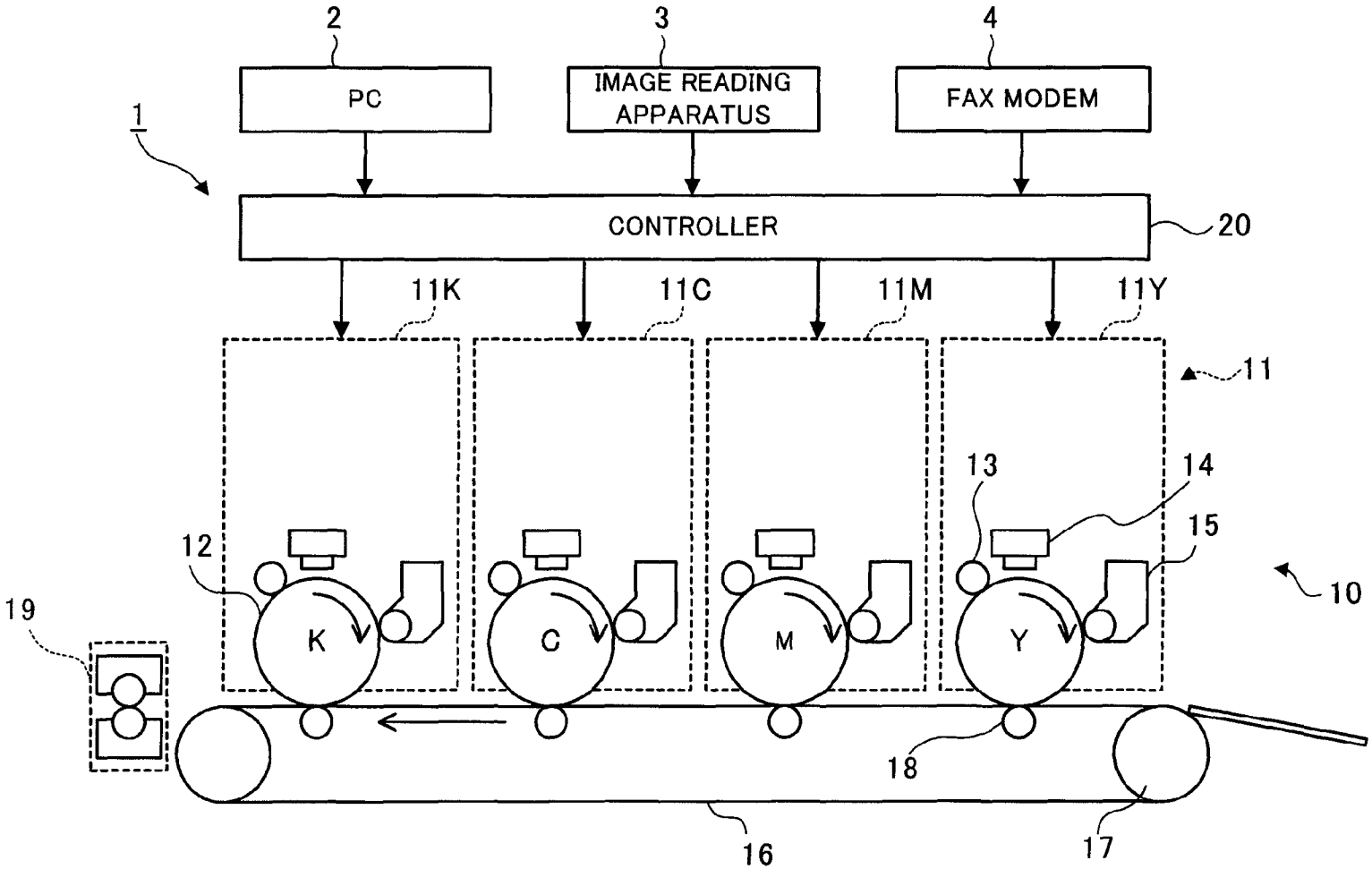
FIG. 1 shows an example of an overall configuration of an image forming apparatus to which the exemplary embodiment is applied.

FIG. 1 shows an example of an overall configuration of an image forming apparatus 1 to which the exemplary embodiment is applied. The image forming apparatus 1 includes an image formation processing unit 10 and a controller 20. The image formation processing unit 10 forms images respectively corresponding to different color image data sets. The controller 20, which is connected to an external device such as a personal computer (PC) 2, an image reading apparatus 3 or a FAX modem 4, performs image processing on image data received from the above device and controls the operations of the entire image forming apparatus 1.

The image formation processing unit 10 includes four image forming units 11 (11Y, 11M, 11C and 11K, specifically) arranged at intervals. Each image forming unit 11 includes a photoconductive drum 12, a charging device 13, a LED print head (LPH) 14 and a developing device 15. The photoconductive drum 12 is an example of an image carrier. The charging device 13 charges the photoconductive drum 12. The LPH 14 as an example of an exposure device exposes the charged photoconductive drum 12 in accordance with the image data transmitted from the controller 20. The developing device 15 develops an electrostatic latent image formed on the photoconductive drum 12 with toner. In addition, the image formation processing unit 10 further includes a transport belt 16, a drive roll 17, transfer rolls 18 and a fixing device 19. The transport belt 16 transports a paper sheet on which color toner images respectively formed on the photoconductive drums 12 of the image forming units 11 are to be transferred by multilayer transfer. The drive roll 17 drives the transport belt 16. Each transfer roll 18 transfers a toner image formed on the corresponding photoconductive drum 12 onto a paper sheet. The fixing device 19 heats and presses to fix a toner image transferred but unfixed on a paper sheet.

Figure 2:
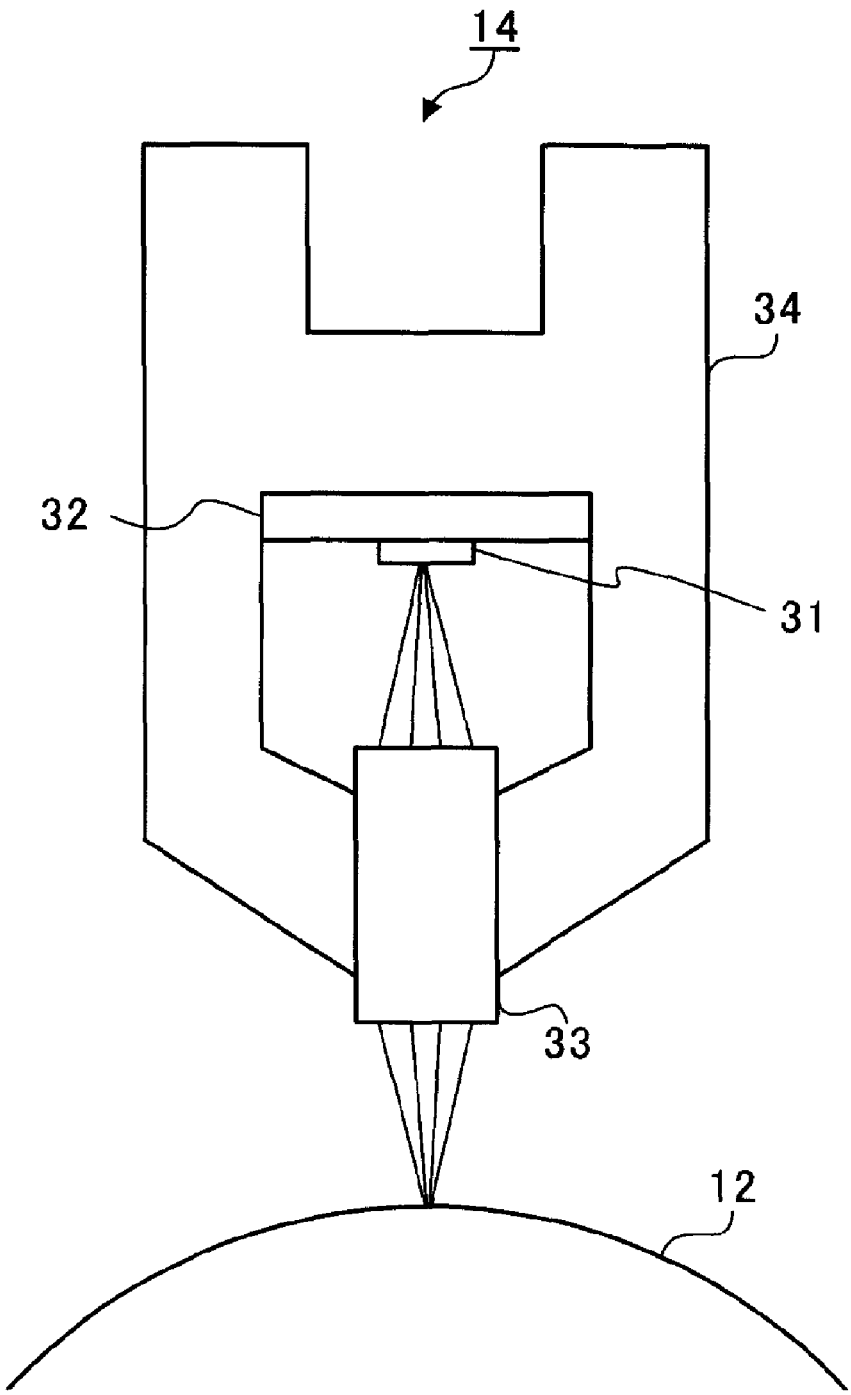
FIG. 2 is a cross-sectional view of a structure of the LPH.

FIG. 2 is a cross-sectional view of a structure of the LPH 14. The LPH 14 includes a light-emitting unit 31, a printed circuit board 32 and a rod lens array 33. The light-emitting unit 31 includes an array of a large number of light-emitting thyristors as an example of light-emitting elements. The printed circuit board 32 supports the light-emitting unit 31 and includes a drive circuit 40 and wiring formed thereon. The drive circuit 40 controls the drive of the light-emitting unit 31 (see FIG. 3 to be described later). The rod lens array 33 as an example of an optical member focuses light beams emitted by the respective light-emitting thyristors onto the photoconductive drum 12. The printed circuit board 32 and the rod lens array 33 are held by a housing 34. Here, the light-emitting unit 31 is formed by arraying as many light-emitting thyristors as correspond to the intended number of pixels in a fast scan direction. Note that, in the present exemplary embodiment, a light output device is formed of the light-emitting unit 31, the drive circuit 40 and the printed circuit board 32.

Figure 3:
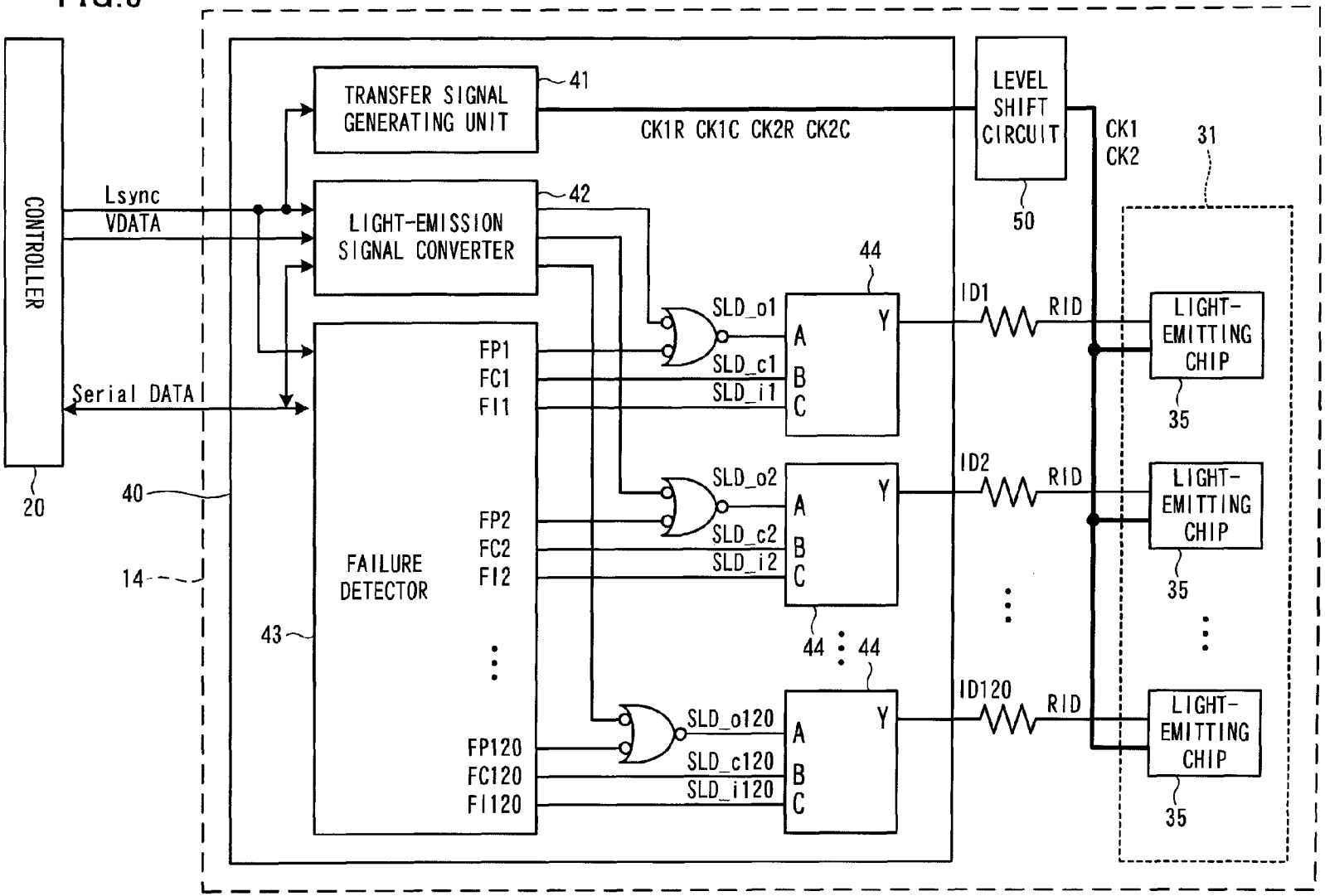
FIG. 3 is a circuit block diagram illustrating a circuit configuration of the LPH.

FIG. 3 is a circuit block diagram illustrating a circuit configuration of the LPH 14. This LPH 14 includes the above-mentioned light-emitting unit 31, the drive circuit 40 and a level shift circuit 50 provided between the light-emitting unit 31 and the drive circuit 40. Note that, in the present exemplary embodiment, a light-emitting device is formed of the light-emitting unit 31 and the drive circuit 40 mounted on the printed circuit board 32.

The light-emitting unit 31 is formed by arraying 120 light-emitting chips 35 in a line. Each light-emitting chip 35 as an example of a light-emitting member includes 128 light-emitting thyristors and 128 transfer thyristors. These 128 light-emitting thyristors are arrayed in a straight line, and the 128 transfer thyristors function as switch elements for causing the light-emitting thyristors to emit light, respectively.

Meanwhile, the drive circuit 40 includes a transfer signal generating unit 41, a light-emission signal converter 42, a failure detector 43 and multiple input/output units 44. Here, the transfer signal generating unit 41 generates transfer signals for the transfer thyristors of the light-emitting chips 35 constituting the light-emitting unit 31, on the basis of a line synchronizing signal Lsync inputted by the controller 20. The light-emission signal converter 42 converts image data VDATA inputted by the controller 20 into signals for light-emission for the light-emitting thyristors of the light-emitting chips 35 constituting the light-emitting unit 31 and outputs the signals for light-emission, in synchronization with the line synchronizing signal Lsync inputted by the controller 20.

The failure detector 43 as an example of a detection unit, another detection unit or a judging unit detects presence or absence of disconnection in the wiring for the light-emitting thyristors of the light-emitting chips 35 constituting the light-emitting unit 31 and presence or absence of transfer trouble of the transfer thyristors of the light-emitting chips 35 by a method to be described later. The 120 input/output units 44 in total are provided corresponding to the respective light-emitting chips 35. Each input/output unit 44 has a function of outputting the signal for light-emission to be used for image formation inputted by the light-emission signal converter 42 to the target light-emitting chip 35, in an image forming operation to be described later. In addition, the input/output unit 44 has the following functions in a failure detection operation to be described later: outputting a signal for light-emission to be used for failure detection inputted by the failure detector 43 to the target light-emitting chip 35; and outputting, to the failure detector 43, a resultant output of this light-emitting chip 35.

Here, each input/output unit 44 as an example of a light-emission signal supply unit includes an input terminal A for signal for light-emission, a control signal input terminal B, an input/output terminal Y and a failure signal output terminal C. To the input terminal A for signal for light-emission, selectively inputted is the signal for light-emission outputted from the light-emission signal converter 42 or from the corresponding one of output terminals FP (FP1 to FP120) of the failure detector 43. Specifically, the selected signals for light-emission are inputted to the input terminals A for signal for light-emission as signals for light-emission SLD_o (SLD_o1 to SLD_o120), respectively. To the control signal input terminals B, inputted are control signals SLD_c (SLD_c1 to SLD_c120) outputted from control terminals FC (FC1 to FC120) of the failure detector 43, respectively. The input/output terminals Y are used for data exchange to/from the respective light-emitting chips 35. On the basis of electric potentials of these input/output terminals Y (ID (ID1 to ID120)), failure detection signals SLD_i (SLD_i1 to SLD_i120) are determined, respectively. The determined failure detection signals SLD_i (SLD_i1 to SLD_i120) are outputted from the failure signal output terminals C to input terminals FI (FI1 to FI120) of the failure detector 43, respectively. Note that the controller 20 bidirectionally communicates with the light-emission signal converter 42 and with the failure detector 43 by using serial data.

In addition, a light-emission current limiting resistor RID is connected between each of the input/output terminals Y of the respective input/output units 44 provided in the drive circuit 40 and the corresponding one of the light-emitting chips 35. The light-emission current limiting resistor RID limits the amount of current flowing between the input/output terminal Y and the light-emitting chip 35. Note that a resistance value of each light-emission current limiting resistor RID is set to approximately 100Ω, for example.

Meanwhile, the level shift circuit 50 provided between the transfer signal generating unit 41 included in the drive circuit 40 and the light-emitting chips 35 included in the light-emitting unit 31 has a function of shifting a level of each transfer signal outputted by the transfer signal generating unit 41. Note that the transfer signal generating unit 41 outputs four transfer signals CK1R, CK1C, CK2R and CK2C to the level shift circuit 50, as described later. In response, the level shift circuit 50 outputs two transfer signals, that is, a first transfer signal CK1 and a second transfer signal CK2, to the light-emitting chips 35.

Figure 4:
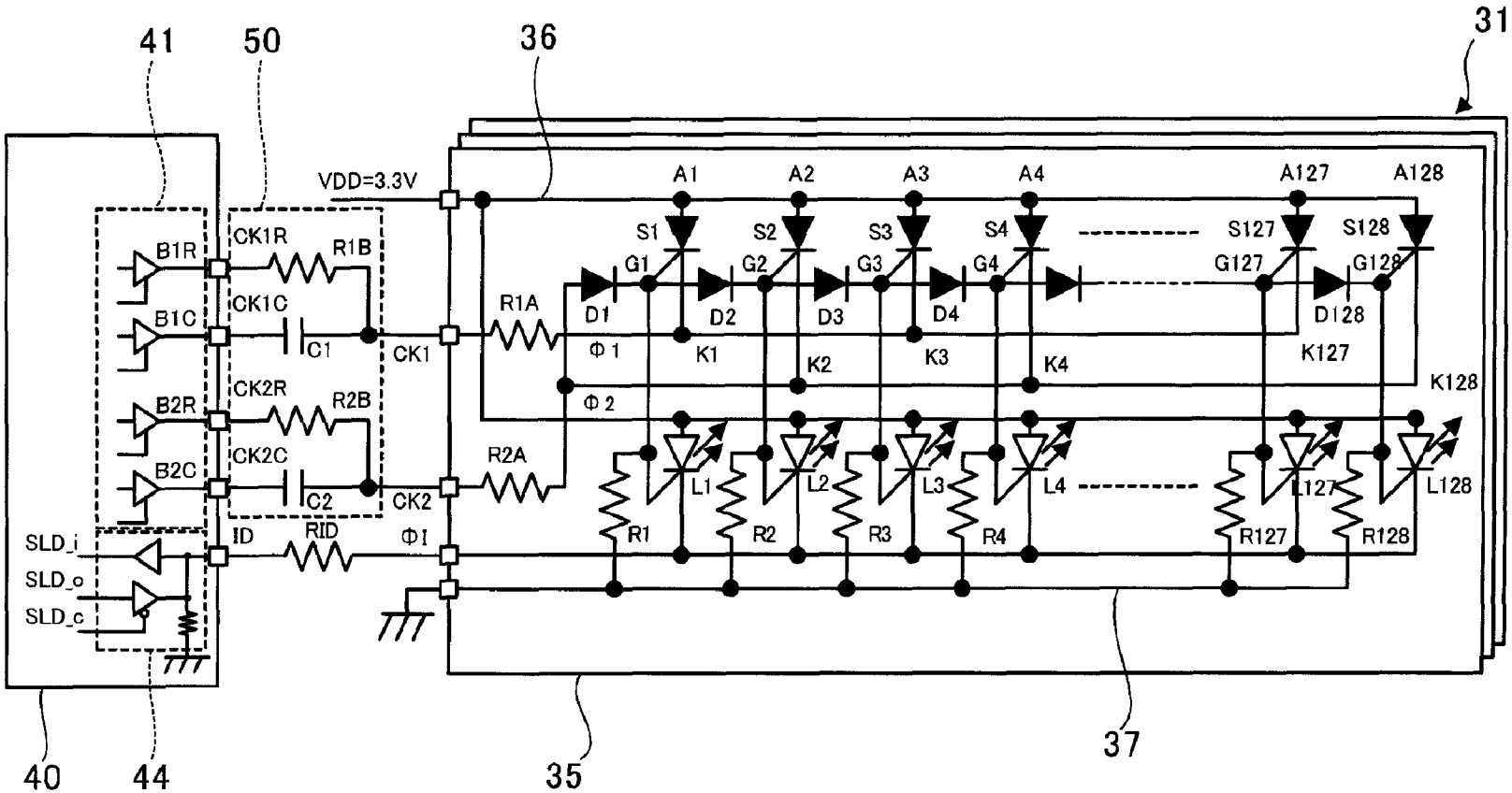
FIG. 4 is a circuit diagram illustrating a configuration of the drive circuit, the level shift circuit and the light-emitting unit in each LPH.

FIG. 4 is a circuit diagram illustrating a configuration of the drive circuit 40, the level shift circuit 50 and the light-emitting unit 31 in each LPH 14. Note that FIG. 4 shows, as a representative example, one of the 120 light-emitting chips 35, which are arrayed in series to constitute the light-emitting unit 31 as mentioned above.

The light-emitting chip 35 includes 128 transfer thyristors S1 to S128, 128 light-emitting thyristors L1 to L128, 128 diodes D1 to D128, 128 resistors R1 to R128 and two transfer current limiting resistors R1A and R2A. Each of the transfer thyristors S1 to S128 is an example of a switch element, while each of the light-emitting thyristors L1 to L128 is an example of a light-emitting element. The two transfer current limiting resistors R1A and R2A prevent excessive currents from flowing through first and second signal lines Φ1 and Φ2. Note that each of the other light-emitting chips 35 also has a similar configuration.

In the light-emitting chip 35, anode terminals A1 to A128 of the respective transfer thyristors S1 to S128 are connected to a power supply line 36. The power supply line 36 is supplied with a power supply voltage VDD (=3.3 V) from a power supply not shown in the figure.

The first transfer signal CK1 outputted from the transfer signal generating unit 41 of the drive circuit 40 through the level shift circuit 50 is inputted to cathode terminals K1, K3, . . . , K127 of the respective odd-numbered transfer thyristors S1, S3, . . . , S127 through the transfer current limiting resistor R1A. Meanwhile, the second transfer signal CK2 outputted from the transfer signal generating unit 41 of the drive circuit 40 through the level shift circuit 50 is inputted to cathode terminals (output terminals) K2, K4, . . . , K128 of the respective even-numbered transfer thyristors S2, S4, . . . , S128 through the transfer current limiting resistor R2A.

On the other hand, gate terminals G1 to G128 of the transfer thyristors S1 to S128 are connected to a power supply line 37 through the resistors R1 to R128 provided corresponding to the transfer thyristors S1 to S128, respectively. Note that, the power supply line 37 is grounded.

In addition, the gate terminals G1 to G128 of the transfer thyristors S1 to S128 are connected to gate terminals of the light-emitting thyristors L1 to L128, respectively. To the gate terminals G1 to G128 of the transfer thyristors S1 to S128, cathode terminals of the diodes D1 to D128 are also connected, respectively. Moreover, to each of the gate terminals G1 to G127 of the respective transfer thyristor S1 to S127, connected is an adjacent one of anode terminals of the diodes D2 to D128 that is labeled with a number larger by one than the transfer thyristor. Meanwhile, to an anode terminal of the diode D1, which is connected to the transfer signal generating unit 41 of the drive circuit 40 through the transfer current limiting resistor R2A and the level shift circuit 50, the second transfer signal CK2 is inputted.

On the other hand, anode terminals of the respective light-emitting thyristors L1 to L128 are connected to the power supply line 36 and thus supplied with the power supply voltage VDD. Meanwhile, cathode terminals of the respective light-emitting thyristors L1 to L128 are connected to the corresponding input/output unit 44 of the drive circuit 40 through the corresponding light-emission current limiting resistor RID provided outside of the light-emitting chip 35. Accordingly, a light-emission signal ΦI is inputted from this input/output unit 44 to the cathode terminals of the respective light-emitting thyristors L1 to L128.

Note that the light-emitting chip 35 is provided with the transfer thyristors S1 to S128, the light-emitting thyristors L1 to L128, the diodes D1 to D128 and the resistors R1 to R128 by forming a pnpn structure on a semiconductor substrate and processing the thus-formed pnpn layers by etching and the like.

Meanwhile, the transfer signal generating unit 41, provided in the drive circuit 40, includes three-state buffers B1R and B1C. The three-state buffers B1R and B1C respectively output the transfer signals CK1R and CK1C, both of which are used for generating the first transfer signal CK1. Moreover, the transfer signal generating unit 41 further includes three-state buffers B2R and B2C. The three-state buffers B2R and B2C respectively output the transfer signals CK2R and CK2C, both of which are used for generating the second transfer signal CK2. Each of these three-state buffers B1R, B1C, B2R and B2C is formed of a three-state output circuit that may be set to three states of: a High-z (referred to as Hiz in the following description) state in addition to two states of a H state (1: output state with a high electric potential) and a L state (0: output state with a low electric potential). Here, the Hiz state indicates a substantially open state due to a high impedance output. Accordingly, under the Hiz state, the three-state output circuit causes substantially no restriction to an output electric potential.

To a region of the level shift circuit 50, the cathode terminals K1, K3, . . . , K127 of the respective odd-numbered transfer thyristors S1, S3, . . . , S127 are connected via the transfer current limiting resistor R1A. In this region of the level shift circuit 50, formed is a circuit including a parallel branch of signal lines respectively connected to a resistor R1B linking to the three-state buffer B1R and a capacitor C1 linking to the three-state buffer B1C.

In addition, to another region of the level shift circuit 50, the cathode terminals K2, K4, . . . , K128 of the respective even-numbered transfer thyristors S2, S4, . . . , S128 and the anode terminal of the diode D1 are connected via the transfer current limiting resistor R2A. In this region of the level shift circuit 50, formed is a circuit including a parallel branch of signal lines respectively connected to a resistor R2B linking to the three-state buffer B2R and a capacitor C2 linking to the three-state buffer B2C.

Figure 5A:
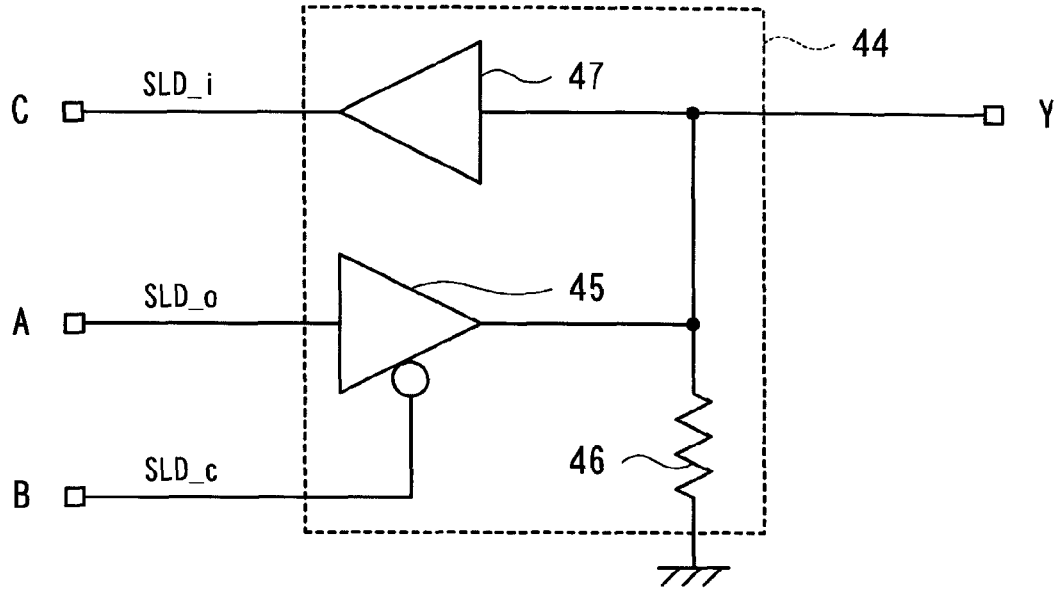
FIG. 5A is a diagram illustrating each input/output unit provided in the drive circuit by using logic symbols.

FIG. 5A is a diagram illustrating each input/output unit 44 provided in the drive circuit 40 by using logic symbols. As shown in FIG. 5A, the input/output unit 44 includes an output buffer 45, a pull-down resistor 46 and an input buffer 47. In other words, the input/output unit 44 is formed of a bidirectional buffer.

Here, the output buffer 45 as an example of an output circuit is formed of a three-state output circuit, that is, a three-state buffer, as with the three-state buffer B1R and the like. The input terminal A for signal for light-emission to which the signal for light-emission SLD_o is inputted is connected to an input terminal of the output buffer 45, while the control signal input terminal B to which a control signal SLD_c is inputted is connected to a control terminal of the output buffer 45. Meanwhile, the pull-down resistor 46, which serves as a ground resistor, is connected to an output terminal of the output buffer 45, an example of an output region. The pull-down resistor 46 has a resistance value of, for example, approximately 100 kΩ and is grounded.

Moreover, to the input buffer 47 as an example of an input circuit inputted is an electric potential at a connection between an input terminal of the input buffer 47 and the pull-down resistor 46, that is, an electric potential of the input/output terminal Y. In response, the input buffer 47 is to output, as the failure detection signal SLD_i, either H (=1) or L (=0) to the failure signal output terminal C. Specifically, the input buffer 47 outputs H (=1) if the electric potential of the input/output terminal Y is 1.4 V or more, and outputs L (=0) if the electric potential of the input/output terminal Y is lower than 1.4 V, for example.

Figure 5B:
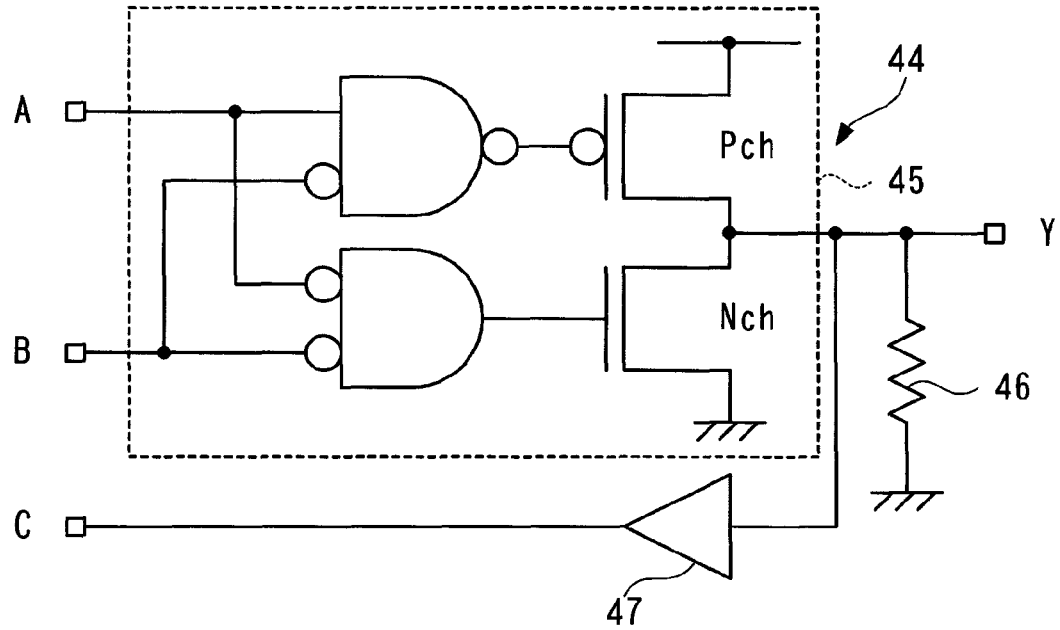
FIG. 5B shows a circuit configuration of the above-mentioned output buffer of the input/output unit.

FIG. 5B shows a circuit configuration of the above-mentioned output buffer 45 of the input/output unit 44. In the present exemplary embodiment, the output buffer 45 includes a Pch transistor and an Nch transistor having different output current capacities from each other to set an output current for the H output smaller than that of the L output.

Figure 6:
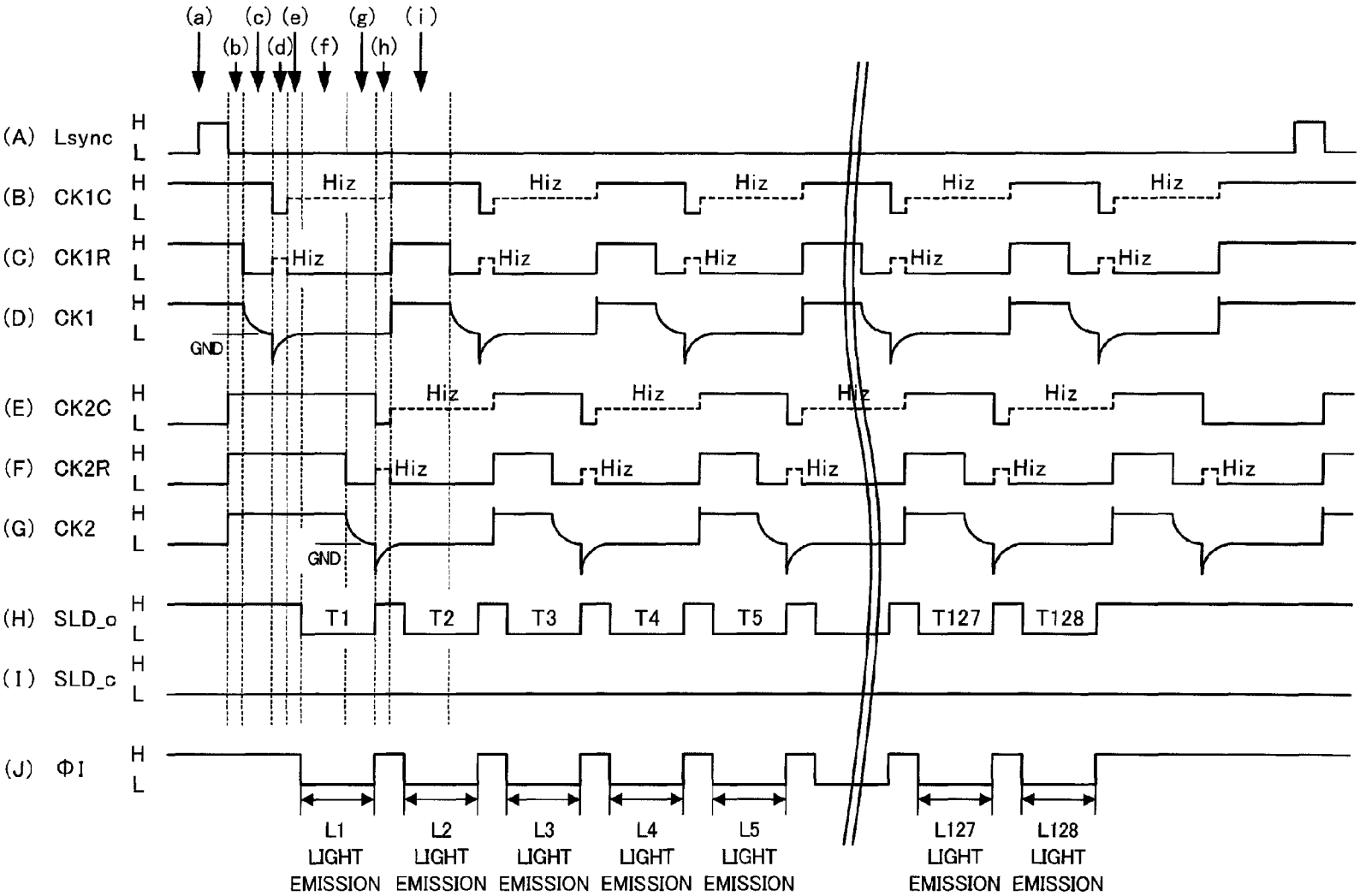
FIG. 6 is a timing chart for illustrating drive of the LPH in a normal image forming operation.

Next, a description will be given of drive of each LPH 14 in a normal image forming operation with reference to a timing chart shown in FIG. 6 as well as the foregoing FIGS. 3 to 5B. Note that the timing chart shown in FIG. 6 illustrates, as an example, an operation of one of the 120 light-emitting chips 35 constituting the light-emitting unit 31. In addition, the timing chart describes a case where all the light-emitting thyristors L1 to L128 constituting the light-emitting chip 35 perform an optical writing operation (emit light).

(1) Firstly, in the initial condition, a reset signal (RST) not shown in the figure is inputted to the drive circuit 40 by the controller 20. In response, the transfer signal generating unit 41 of the drive circuit 40 sets the transfer signal CK1R to "H" ((C) in FIG. 6) by setting the output electric potential of the three-state buffer B1R to the high level "H" (hereinafter simply referred to as "H"). In addition, the transfer signal generating unit 41 sets the transfer signal CK1C to "H" ((B) in FIG. 6) by setting the three-state buffer B1C to "H." As a result, the first transfer signal CK1 is set to "H" ((D) in FIG. 6) in the level shift circuit 50. Meanwhile, the transfer signal generating unit 41 of the drive circuit 40 sets the transfer signal CK2R to "L" ((F) in FIG. 6) by setting the output electric potential of the three-state buffer B2R to the low level (hereinafter simply referred to as "L"). In addition, the transfer signal generating unit 41 sets the transfer signal CK2C to "L" ((E) in FIG. 6) by setting the three-state buffer B2C to "L." As a result, the second transfer signal CK2 is set to "L" ((G) in FIG. 6) in the level shift circuit 50. Consequently, all the transfer thyristors S1 to S128 are set to be turned off.

Note that, in the initial condition, no image data VDATA is inputted to the drive circuit 40 by the controller 20. Accordingly, the light-emission signal converter 42 of the drive circuit 40 outputs no signal for light-emission, and thus the signal for light-emission SLD_o is set to "H" ((H) in FIG. 6).

During the image forming operation, the control signal SLD_c outputted by the failure detector 43 of the drive circuit 40 remains set to "L" ((I) in FIG. 6). Thus, in the initial condition, the light-emission signal ΦI outputted by the output buffer 45 of the corresponding input/output unit 44 is set to "H" ((J) in FIG. 6).

(2) Secondly, the line synchronizing signal Lsync outputted subsequent to the reset signal (RST) by the controller 20 is set to "H" only for a period ((a) in FIG. 6). This causes the light-emitting unit 31 (the light-emitting chips 35) to start operating. Then, in synchronization with the fall of the line synchronizing signal Lsync, the transfer signal generating unit 41 sets the transfer signals CK2C and CK2R to "H" as indicated by (E) and (F) in FIG. 6 by setting the three-state buffers B2C and B2R to "H," respectively. As a result, the second transfer signal CK2 is set to "H" as indicated by (G) in FIG. 6 in the level shift circuit 50 ((b) in FIG. 6).

(3) After the second transfer signal CK2 is set to "H," the transfer signal generating unit 41 sets the transfer signal CK1R to "L" as indicated by (C) in FIG. 6 by setting the three-state buffer B1R to "L" ((c) in FIG. 6). This causes charge accumulated in the capacitor C1 to flow toward the resistor R1B in the level shift circuit 50, and thus the electric potential of the first transfer signal CK1 becomes GND (0 V) after a while. Here, since the electric potential of the transfer signal CK1C is set to 3.3 V, an electric potential difference between both ends of the capacitor C1 is 3.3 V (=VDD).

(4) Subsequently, the transfer signal generating unit 41 sets the transfer signal CK1C to "L" as indicated by (B) in FIG. 6 by setting the three-state buffer B1C to "L" ((d) in FIG. 6). As a result, the electric potential of the first transfer signal CK1 decreases to approximately −3.3 V since charge is accumulated in the capacitor C1. At this time, the electric potential (Vg1) of the gate terminal G1 becomes approximately 1.9 V, which is obtained by Vg1=(the electric potential of CK2)−Vf. Here, the electric potential of the second transfer signal CK2 is approximately 3.3 V while Vf, which is a forward voltage of the diode D1 formed of AlGaAs, is approximately 1.4 V. In addition, the electric potential of the first transfer signal CK1 becomes 0.5 V, which is obtained by Vg1−Vf where Vg1 is the electric potential of G1. Here, since the electric potential of the light-emission signal ΦI is 0 V, an electric potential difference of approximately 3.8 V is generated between the light-emission signal ΦI and the first transfer signal CK1.

Note that, in the light-emitting chip 35, the diodes D1 to D128, the transfer thyristors S1 to S128 and the light-emitting thyristors L1 to L128 are formed by a configuration of the same pnpn layers, as described above. Accordingly, when the forward voltage Vf of each of the diodes D1 to D128 is approximately 1.4 V, the forward voltage Vf of each of the transfer thyristors S1 to S128 and the light-emitting thyristors L1 to L128 is approximately 1.4 V, too.

This condition causes a gate current to begin flowing in the transfer thyristor S1 through the route from the gate terminal G1 to the first signal line Φ1 and from the first signal line Φ1 to the first transfer signal CK1. Note that, concurrently with setting the three-state buffer B1C to "L," the transfer signal generating unit 41 sets the transfer signal CK1R to "Hiz" by setting the three-state buffer B1R to "Hiz" so as to prevent the gate current from flowing backward.

After that, the gate current flowing in the transfer thyristor S1 turns on the transfer thyristor S1 and continues to gradually increase. In addition, a current flows in the capacitor C1 of the level shift circuit 50. As a result, the electric potential of the first transfer signal CK1 also gradually increases.

(5) After a while during which the electric potential of the first transfer signal CK1 increases toward GND, the transfer signal generating unit 41 sets the transfer signal CK1R to "L" by setting the three-state buffer B1R to "L" ((e) in FIG. 6). This increases the electric potential of the gate terminal G1, and thus increases the electric potential of the first transfer signal CK1. As a result, a current begins to flow in the resistor R1B of the level shift circuit 50. Meanwhile, the current flowing in the capacitor C1 of the level shift circuit 50 is gradually decreases with increase in the electric potential of the first transfer signal CK1. In addition, concurrently with setting the three-state buffer B1R to "L," the transfer signal generating unit 41 sets the transfer signal CK1C to "Hiz" as indicated by (B) in FIG. 6 by setting the three-state buffer B1C to "Hiz" ((e) in FIG. 6).

When the transfer thyristor S1 is completely turned on to be a steady state, a current for keeping the transfer thyristor S1 in the turned-on state flows in the resistor R1B of the level shift circuit 50 while no current flows in the capacitor C1.

(6) Under the condition where the transfer thyristor S1 is completely turned on, the signal for light-emission SLD_o is set to "L" as indicated by (H) in FIG. 6 ((f) in FIG. 6). Here, the signal for light-emission SLD_o is generated on the basis of image data VDATA outputted by the controller 20 and is outputted by the light-emission signal converter 42. As mentioned above, the control signal SLD_c remains set to "L" during the image forming operation ((I) in FIG. 6). As a result, the light-emission signal ΦI outputted by the corresponding input/output unit 44 becomes "L" ((f) in FIG. 6). Here, (the electric potential of the gate terminal G1)>(the electric potential of the gate terminal G2), more specifically, (the electric potential of the gate terminal G1)−(the electric potential of the gate terminal G2)=Vf=1.4 V. Accordingly, the light-emitting thyristor L1 whose gate terminal is connected to that of the transfer thyristor S1 is turned on before the light-emitting thyristor L2 whose gate terminal is connected to that of the transfer thyristor S2 is turned on. As a result, the light-emitting thyristor L1 emits light. When the light-emitting thyristor L1 is turned on, the electric potential of the first signal line Φ1 increases to satisfy (the electric potential of the first signal line Φ1)=(the electric potential of the gate terminal G2)=1.9 V. Accordingly, none of the downstream light-emitting thyristors L2 to L128 is turned on. In other words, among the 128 light-emitting thyristors L1 to L128, only the light-emitting thyristor L1, which has the highest gate voltage, is turned on and emits light.

(7) Next, the transfer signal generating unit 41 sets the transfer signal CK2R to "L" as indicated by (F) in FIG. 6 by setting the three-state buffer B2R to "L" ((g) in FIG. 6). This causes a current to flow as in the case of (c) in FIG. 6, and thus a voltage is generated between both ends of the capacitor C2 of the level shift circuit 50. In a steady state just before the end of (g) in FIG. 6, the electric potentials of the respective points are slightly different from those just before the end of (c) in FIG. 6 since the electric potential of the gate terminal G2 is 1.9 V, but the differences does not affect the operation for the following reason. In the steady state just before the end of (g) in FIG. 6, the electric potential of the second signal line Φ2 is approximately 0.5 V, which is obtained by (the electric potential of the second signal line Φ2)=(the electric potential of the gate terminal G2)−Vf=1.9−1.4. Thus, though a gate current also flows in the transfer thyristor S2, the amount of the current is too small to turn on the transfer thyristor S2.

(8) Subsequently, the transfer signal generating unit 41 sets the transfer signal CK2C to "L" as indicated by (E) in FIG. 6 by setting the three-state buffer B2C to "L" ((h) in FIG. 6). A gate current flows in the transfer thyristor S2 downstream to the transfer thyristor S1, so that the transfer thyristor S2 is turned on. In other words, in this condition, the adjacent transfer thyristors S1 and S2 are simultaneously turned on. Note that, concurrently with setting the three-state buffer B2C to "L," the transfer signal generating unit 41 sets the transfer signal CK2R to "Hiz" by setting the three-state buffer B2R to "Hiz" so as to prevent the gate current from flowing backward.

In addition, the signal for light-emission SLD_o outputted by the light-emission signal converter 42 is set to "H" ((H) in FIG. 6) before the three-state buffer B2C is set to "L." Note that, in the case shown in FIG. 6, the signal for light-emission SLD_o is set to "H" at the exact timing when the three-state buffer B2C is set to "L."

(9) Then, the transfer signal generating unit 41 sets the transfer signals CKLC and CKLR to "H" at a time as indicated by (B) and (C) in FIG. 6 by setting the three-state buffers B1C and B1R to "H" at the same time ((i) in FIG. 6). As a result, the first transfer signal CK1 becomes "H." When the first transfer signal CK1 becomes "H," the transfer thyristor S1 is turned off and discharges electricity through the resistor R1. Thereby, the electric potential of the gate terminal G1 gradually decreases. Meanwhile, the electric potential of the gate terminal G2 of the transfer thyristor S2 becomes 3.3 V, so that the transfer thyristor S2 is completely turned on.

In addition, concurrently with setting the three-state buffers B1C and B1R to "H" at the same time, the transfer signal generating unit 41 sets the transfer signal CK2C to "Hiz" by setting the three-state buffer B2C to "L." At the same time, the transfer signal generating unit 41 also sets the transfer signal CK2R to "L" by setting the three-state buffer B2R to high impedance (Hiz) ((i) in FIG. 6).

(10) Under the condition where the transfer thyristor S2 is completely turned on, the signal for light-emission SLD_o is set to "L" as indicated by (H) in FIG. 6. As mentioned above, the control signal SLD_c remains set to "L" during the image forming operation ((I) in FIG. 6). As a result, the light-emission signal ΦI becomes "L" ((i) in FIG. 6), and thus the light-emitting thyristor L2 emits light.

(11) After that, similar control is performed on the transfer thyristors S3 to S128 and light-emitting thyristors L3 to L128 so as to cause the light-emitting thyristors L3 to L128 to sequentially emit light. Then, after the last light-emitting thyristor L128 stops emitting light, another reset signal (RST) is inputted to the drive circuit 40, so that one transfer operation round is completed. The drive of the transfer thyristors S1 to S128 and the light-emitting thyristors L1 to L128 is controlled by repeating the above-mentioned procedure.

Note that, the above description has been given of the case where all the light-emitting thyristors L1 to L128 constituting the light-emitting chip 35 are caused to emit light, as an example. If not all the light-emitting thyristors L1 to L128 need to emit light, the signal for light-emission SLD_o, that is, the light-emission signal ΦI, is kept set to "H" in periods where any of transfer thyristors S1 to S128 corresponding to the light-emitting thyristors that do not need to emit light are turned on.

In the following description, a period in which the signal for light-emission SLD_o is set to "L" so as to set the light-emitting thyristor L1 ready to emit light will be referred to as 1st period T1. Similarly, periods in which the signal for light-emission SLD_o is set to "L" so as to set the other light-emitting thyristors L2 to L128 ready to emit light will be referred to as 2nd to 128th periods T2 to T128, respectively. In the image forming operation, the light-emitting thyristors L1 to L128 of each light-emitting chip 35 are set ready to emit light by providing the 1st to 128th periods T1 to T128, 128 periods in total, respectively.

Hereinabove, the operation of the LPH 14 in the normal image forming operation has been described. Additionally, each LPH 14 according to the present exemplary embodiment performs a failure detection operation on the light-emitting chips 35 constituting the light-emitting unit 31 in periods where the image forming operation is not performed. Note that what is detected as failure in the present exemplary embodiment is: disconnection in the wiring for the light-emitting thyristors L1 to L128 of the light-emitting chips 35; and transfer trouble of the transfer thyristors S1 to S128 of the light-emitting chips 35.

Figure 7:
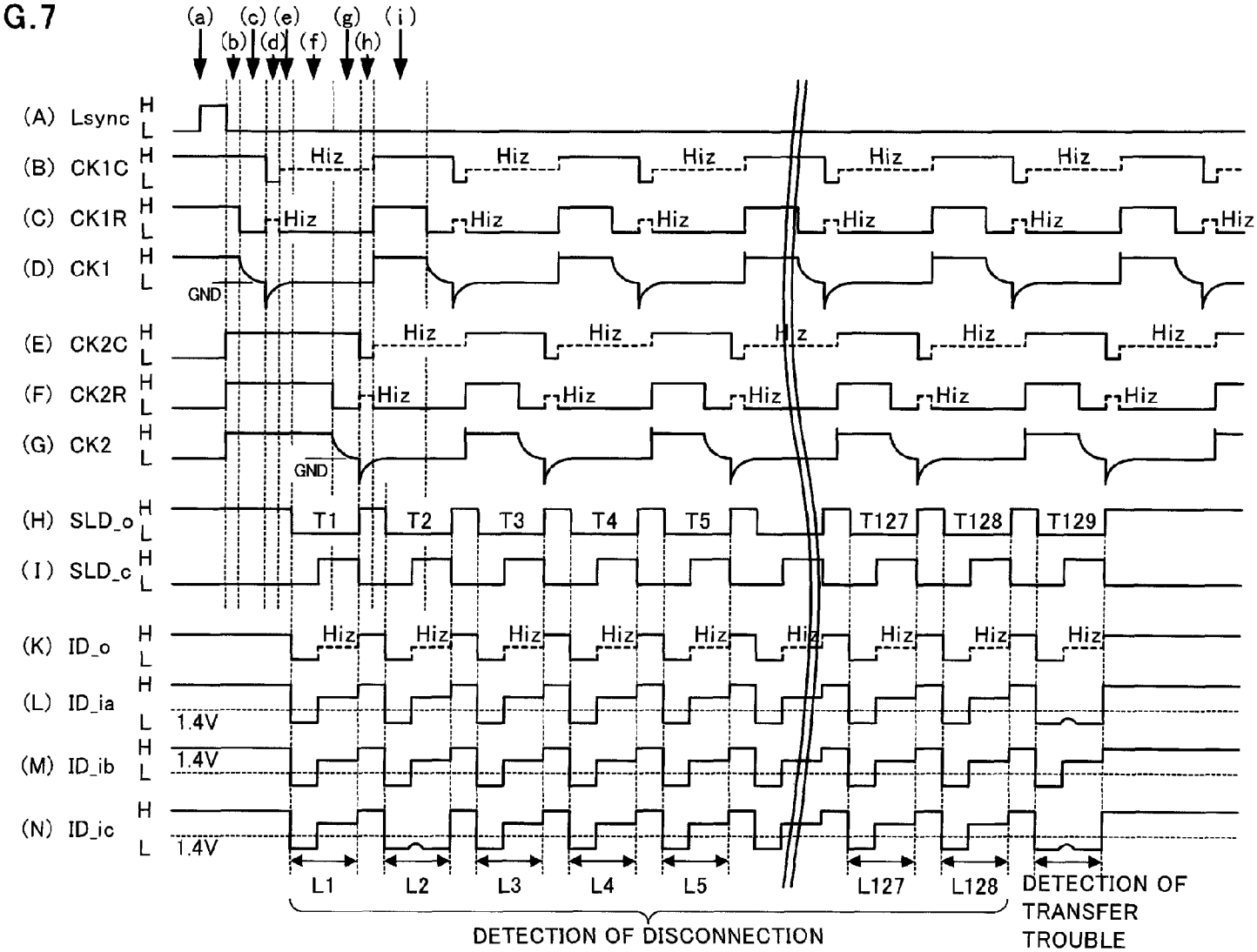
FIG. 7 is a timing chart for illustrating drive of the LPH in the failure detection operation.

Next, a description will be given of drive of the LPH 14 in the failure detection operation with reference to a timing chart shown in FIG. 7 as well as the foregoing FIGS. 3 to 5B. As in FIG. 6, the timing chart shown in FIG. 7 illustrates, as an example, an operation of one of the 120 light-emitting chips 35 constituting the light-emitting unit 31. The output operations and output waveforms of the line synchronizing signal Lsync and the first and second transfer signals CK1 and CK2 in the failure detection operation are completely the same as those in the above-mentioned image forming operation, and thus the detailed description thereof will be omitted. However, unlike the above-mentioned image forming operation where the signal for light-emission SLD_o is outputted by the light-emission signal converter 42, the signal for light-emission SLD_o is outputted by the failure detector 43 in the failure detection operation.

Moreover, in the above-mentioned image forming operation, the 128 transfer periods, that is, the 1st to 128th periods T1 to T128, are respectively set for 128 pairs of the transfer thyristors S1 to S128 and the light-emitting thyristors L1 to L128 of each light-emitting chip 35 every transfer operation round. On the other hand, in the failure detection operation, that is, 129 transfer periods, the 1st to 129th periods T1 to T129, are set every transfer operation round. In other words, the number of cycles included in the transfer signal generated in the failure detection operation is larger than the number (128) of the light-emitting thyristors provided in each light-emitting chip 35.

In the failure detection operation, while the transfer thyristor S1 is turned on, the signal for light-emission SLD_o outputted by the failure detector 43 provided in the drive circuit 40 is set to "L" as indicated by (H) in FIG. 7 ((f) in FIG. 7), for example. At the outset of (f) in FIG. 7, the control signal SLD_c outputted by the failure detector 43 is set to "L" as indicated by (I) in FIG. 7 (first state). Thereafter, the control signal SLD_c is set to "H" while the signal for light-emission SLD_o remains set to "L" (second state). Then, the control signal SLD_c is set to "L" again at the exact timing when the signal for light-emission SLD_o is set to "H" (third state). As a result, an output ID_o of the output buffer 45 included in the corresponding input/output unit 44 is set to "L," "Hiz" and "H" in first to third states, respectively, as indicated by (K) in FIG. 7. Note that, in the failure detection operation, the steps of setting to the first to third states described above are repeated a number of times equivalent to the number of transfer periods, that is, 129 times in each light-emitting chip 35.

In the failure detection operation performed in the present exemplary embodiment, the 1st to 128th periods T1 to T128 are used for detecting disconnection in the wiring for the light-emitting thyristors L1 to L128 constituting each light-emitting chip 35, respectively. On the other hand, the 129th period T129 is used for detecting transfer trouble of the transfer thyristors S1 to S128 constituting the light-emitting chip 35. Here, the 1st to 128th periods T1 to T128 respectively correspond to cycles of each transfer signal, the number of which is the same as the number of the multiple light-emitting elements, while the 129th period T129 corresponds to a cycle of the transfer signal that the transfer signal generating unit 41 generates after generating as many cycles as the light-emitting elements.

Here, (L) in FIG. 7 indicates an input ID_i (hereinafter referred to as input ID_ia) of the input buffer 47 of the corresponding input/output unit 44 when no disconnection occurs in the wiring for the light-emitting thyristors L1 to L128 and no transfer trouble occurs in the transfer thyristors S1 to S128, that is, when no failure occurs in the light-emitting chip 35.

Meanwhile, FIG. 8A shows relations, under the above-mentioned condition, among the 1st to 129th periods T1 to T129, the transfer thyristors turned on in the respective periods, and the light-emitting thyristors set ready to emit light by the respective turned-on transfer thyristors.

In the first state, an output ID_o of the output buffer 45 is set to "L." Accordingly, in the above case, currents flow from the light-emitting thyristors L1 to L128 into the output buffer 45 through the light-emission current limiting resistor RID in the first state in the 1st to 128th periods T1 to T128, respectively. Here, the electric potential of the input ID_ia of the input buffer 47 is lower than 1.4 V indicated by the broken line shown in (L) in FIG. 7. As a result, the input buffer 47 outputs, to the failure detector 43, "L" as the failure detection signal SLD_i.

Meanwhile, in the second state, the output ID_o of the output buffer 45 is set to "Hiz." Accordingly, no current flows from the light-emitting thyristors L1 to L128 into the output buffer 45 in the second state in the 1st to 128th periods T1 to T128, respectively. Here, the electric potential of the input ID_ia of the input buffer 47 is approximately 1.9 V, which is obtained by (the power supply voltage)−Vf=3.3−1.4. Accordingly, the input buffer 47 outputs, to the failure detector 43, "H" as the failure detection signal SLD_i since the electric potential of the input ID_ia of the input buffer 47 is not lower than 1.4 V.

On the other hand, in the third state, the output ID_o of the output buffer 45 is set to "H." Accordingly, the electric potential of the input ID_ia of the input buffer 47 is 3.3 V in the third state in the 1st to 128th periods T1 to T128. Thus, the input buffer 47 outputs, to the failure detector 43, "H" as the failure detection signal SLD_i since the electric potential of the input ID_ia of the input buffer 47 is not lower than 1.4 V.

If no transfer trouble occurs, the transfer operation of the transfer thyristors S1 to S128 and the resultant light-emitting operation of the light-emitting thyristors L1 to L128 are completed in the 128th period T128. Hence, when no transfer trouble occurs, there is no transfer thyristor to be turned on in the 129th period T129, and thus no light-emitting thyristor to be set ready to emit light by any turned-on transfer thyristor.

Accordingly, in the first state in the 129th period T129, the output ID_o of the output buffer 45 is set to "L," but there is no light-emitting thyristor set ready to emit light. Thus, the electric potential of the input ID_ia of the input buffer 47 is the same as the electric potential (0 V) of the output ID_o of the output buffer 45, namely, lower than 1.4 V. As a result, the input buffer 47 outputs, to the failure detector 43, "L" as the failure detection signal SLD_i.

Meanwhile, in the second state in the 129th period T129, the output ID_o of the output buffer 45 is set to "Hiz," but there is no light-emitting thyristor set ready to emit light. Thus, the pull-down resistor 46 makes the electric potential of the input ID_ia of the input buffer 47 lower than 1.4 V. As a result, the input buffer 47 outputs, to the failure detector 43, "L" as the failure detection signal SLD_i.

On the other hand, in the third state in the 129th period T129, the output ID_o of the output buffer 45 is set to "H," but there is no light-emitting thyristor set ready to emit light. Thus, the electric potential of the input ID_ia of the input buffer 47 is the same as that of the output ID_o of the output buffer 45, that is, 3.3 V. As a result, the input buffer 47 outputs, to the failure detector 43, "H" as the failure detection signal SLD_i since the electric potential of the input ID_ia of the input buffer 47 is not lower than 1.4 V.

Meanwhile, (M) in FIG. 7 indicates an input ID_i (hereinafter referred to as input ID_ib) of the input buffer 47 of the corresponding input/output unit 44 under the condition where no disconnection occurs in the wiring for the light-emitting thyristors L1 to L128 but where any transfer trouble occurs, for example, between the transfer thyristors S4 and S5. Note that the following description is given to the case where, after transfer trouble occurs between the transfer thyristors S4 and S5, the transfer operation is resumed from the transfer thyristor S1 again, as an example. In addition, assume the case where some transfer trouble occurs between the transfer thyristors S4 and S5 in the first transfer operation round but where no transfer trouble occurs between the transfer thyristors S4 and S5 in the second transfer operation round, as an example.

Meanwhile, FIG. 8B shows relations, under the above-mentioned condition, among the 1st to 129th periods T1 to T129, the transfer thyristors turned on in the respective periods, and the light-emitting thyristors set ready to emit light by the respective turned-on transfer thyristors.

In this case, the waveform of the input ID_ib of the input buffer 47 in the 1st to 128th periods T1 to T128 appears to be the same as that of the input ID_ia indicated by (L) in FIG. 7. However, actually, after the transfer thyristors S1 to S4 are turned on to perform the transfer operation and the respective light-emitting thyristors S1 to S4 are set ready to emit light, the transfer operation is resumed from turning on the transfer thyristor S1 again.

If any transfer trouble occurs, the transfer operation of the transfer thyristors S1 to S128 and the resultant light-emitting operation of the light-emitting thyristors L1 to L128 are not completed in the 128th period T128. For example, in the example shown in FIG. 8B, the transfer thyristor S124 is turned on to set the light-emitting thyristor L124 ready to emit light in the 128th period T128. Hence, when some transfer trouble occurs, there is a transfer thyristor (the transfer thyristor S125, in this case) to be turned on in the 129th period T129, and thus there is a light-emitting thyristor (the light-emitting thyristors L125, in this case) to be set ready to emit light by the turned-on transfer thyristor.

Accordingly, in the first state in the 129th period T129, the output ID_o of the output buffer 45 is set to "L," and the light-emitting thyristor L125 is set ready to emit light. Thus, a current flows from the light-emitting thyristor L125 to the output buffer 45 through the light-emission current limiting resistor RID, so that the electric potential of the input ID_ib of the input buffer 47 is lower than 1.4 V as indicated by (M) in FIG. 7. As a result, the input buffer 47 outputs, to the failure detector 43, "L" as the failure detection signal SLD_i.

Meanwhile, in the second state in the 129th period T129, no current flows from the light-emitting thyristors L125 into the output buffer 45 since the output ID_o of the output buffer 45 is set to "Hiz." Here, the electric potential of the input ID_ib of the input buffer 47 is approximately 1.9 V, which is obtained by (the power supply voltage)−Vf=3.3−1.4, that is, not lower than 1.4 V. Accordingly, the input buffer 47 outputs, to the failure detector 43, "H" as the failure detection signal SLD_i.

On the other hand, in the third state in the 129th period T129, the electric potential of the input ID_ib of the input buffer 47 is approximately 3.3 V, which is not lower than 1.4 V, since the output ID_o of the output buffer 45 is set to "H." Thus, the input buffer 47 outputs, to the failure detector 43, "H" as the failure detection signal SLD_i.

Here, comparison between the input ID_ia of the input buffer 47 indicated by (L) in FIG. 7 and the input ID_ib of the input buffer 47 indicated by (M) in FIG. 7 shows that they take different values from each other in the second state in the 129th period T129. Specifically, the input ID_ia employed when no transfer trouble occurs ((L) in FIG. 7) is "L" in the second state of the 129th period T129, while the input ID_ib employed when transfer trouble occurs ((M) in FIG. 7) is "H" in the second state of the 129th period T129.

Meanwhile, (N) in FIG. 7 indicates an input ID_i (hereinafter referred to as input ID_ic) of the input buffer 47 of the corresponding input/output unit 44 under the condition where no transfer trouble occurs in the transfer thyristors S1 to S128 but where disconnection occurs in the wiring for the light-emitting thyristor L2, for example. Note that the following description is given to the case where, after the emission-ready light-emitting thyristor L2 fails to emit light due to the disconnection, the downstream light-emitting thyristor L3 is set ready to emit light, as an example.

Meanwhile, FIG. 8C shows relations, under the above-mentioned condition, among the 1st to 129th periods T1 to T129, the transfer thyristors turned on in the respective periods, and the light-emitting thyristors set ready to emit light by the respective turned-on transfer thyristors.

In this case, the waveform of the input ID_ic of the input buffer 47 in the 1st period T1 and the 3rd to 128th periods T3 to T128 is the same as that of the input ID_ia indicated by (L) in FIG. 7. By contrast, since the disconnection occurs in the wiring for the light-emitting thyristor L2, the value of the input ID_ic of the input buffer 47 in the second state in the 2nd period T2 is different from that of the input ID_ia indicated by (L) in FIG. 7.

In other words, when, for example, disconnection occurs in the light-emitting thyristor L2, no voltage is applied to the light-emitting thyristor L2. Hence, no electric potential is generated at the input ID_ic of the input buffer 47. Note that the same holds for the case where disconnection occurs in the wiring connected to the light-emitting thyristor L2 or in the transfer thyristor S2.

Under the condition, in the second state, the electric potential of the input ID_ic of the input buffer 47 is unchanged at 0 V since the output ID_o of the output buffer 45 is set to "Hiz." Accordingly, the input buffer 47 outputs "L" as the failure detection signal SLD_i since the electric potential of the input ID_ic is lower than 1.4 V. In other words, the input ID_ia employed when no disconnection occurs in the light-emitting thyristor L2 ((L) in FIG. 7) is "H" in the second state of the 2nd period T2, while the input ID_ic employed when disconnection occurs in the light-emitting thyristor L2 ((N) in FIG. 7) is "L" in the second state of the 2nd period T2.

Even if disconnection occurs, as long as no transfer trouble occurs, the transfer operation of the transfer thyristors S1 to S128 and the resultant light-emitting operation of the light-emitting thyristors L1 to L128 are completed in the 128th period T128. Hence, when no transfer trouble occurs, there is no transfer thyristor to be turned on in the 129th period T129, and thus no light-emitting thyristor to be set ready to emit light by any turned-on transfer thyristor.

In this case, the waveform of the input ID_ic of the input buffer 47 in the 129th period T129 is the same as that of the input ID_ia indicated by (L) in FIG. 7. However, if disconnection occurs and additionally if any transfer trouble occurs, the waveform of the input ID_ic of the input buffer 47 in the 129th period T129 is the same as that of the input ID_ib indicated by (M) in FIG. 7.

In the above-mentioned failure detection operation, the failure detector 43 detects the failure detection signals SLD_i inputted from the respective light-emitting chips 35 in the second state in each of the 1st to 128th periods T1 to T128. Specifically, when any of the failure detection signals SLD_i is "L" (low level) in the second state in any of the 1st to 128th periods T1 to T128, the failure detector 43 judges that disconnection occurs in the light-emitting chip 35.

Additionally, in this failure detection operation, the failure detector 43 detects the failure detection signals SLD_i inputted from the respective light-emitting chips 35 also in the second state in the 129th period T129. Specifically, the failure detector 43 judges that any transfer trouble occurs in a light-emitting chip 35 if it outputs the failure detection signal SLD_i detected as "H" (high level) in the second state in the 129th period T129.

If the failure detector 43 judges that disconnection or transfer trouble occurs in at least one of the light-emitting chips 35, the failure detector 43 outputs a warning signal to a user interface not shown in the figure, and thereby causes the user interface to display a message indicating the occurrence of disconnection or transfer trouble, for example.

Note that, in the present exemplary embodiment, it is detected whether or not any disconnection occurs in the light-emitting thyristors L1 to L128 of the light-emitting chips 35 as well as whether or not any transfer trouble occurs in the transfer thyristors S1 to S128 of the light-emitting chips 35. However, the present invention is not limited to this. For example, the detection may be made only on whether or not any transfer trouble occurs in the transfer thyristors S1 to S128 of the light-emitting chips 35. In this case, the above-mentioned detection operation needs to be performed in the 129th period T129.

Moreover, in the present exemplary embodiment, the detection on whether or not any disconnection occurs in the wiring for the light-emitting thyristors L1 to L128 of the light-emitting chips 35 as well as on whether or not any transfer trouble occurs in the transfer thyristors S1 to S128 of the light-emitting chips 35 is made in the periods where the image forming operation is not performed. However, the present invention is not limited to this. Instead, the failure detection operation may be performed while the image forming operation is performed. This displaces the exposure position by a distance corresponding to the 129th period T129. However, by making the 129th period T129 sufficiently shorter than each of the 1st to 128th periods T1 to T128, image deterioration due to the displacement of the exposure position may be minimized to an extent unperceivable to the human eye.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure device comprising:

a light output device that outputs light for exposing a charged image carrier, the light output device including:

a plurality of light-emitting elements caused to emit light or not to emit light through a control using a light-emission signal;

a plurality of switch elements provided respectively corresponding to the plurality of light-emitting elements, the switch elements being sequentially turned on to set the respective light-emitting elements ready to emit light;

a transfer signal generating unit that generates a transfer signal for sequentially turning on the plurality of switch elements;

a light-emission signal supply unit that supplies the light-emission signal to the plurality of light-emitting elements; and a detection unit that causes the transfer signal generating unit to generate a transfer signal for each failure detection operation, the transfer signal having a plurality of cycles corresponding to transfer periods that detect disconnection in the wiring for the light-emitting elements and also having another cycle after the plurality of cycles corresponding to a transfer period that detects transfer trouble of the switch elements, the total number of cycles of the transfer signal for each failure detection operation being larger than the number of the plurality of light-emitting elements, and that detects an electric potential of an output region of the light-emission signal supply unit while making an output from the light-emission signal supply unit high impedance; and an optical member that focuses light outputted by the light output device onto the image carrier.

2. The exposure device according to claim 1, further comprising a judging unit, wherein the detection unit detects an electric potential of the output region in a cycle after as many cycles as the plurality of light-emitting elements are generated, the cycle being included in a plurality of cycles of a transfer signal generated by the transfer signal generating unit, and the judging unit judges whether or not the plurality of switch elements is normally turned on to perform a transfer operation, on the basis of the electric potential of the output region detected by the detection unit.

3. The exposure device according to claim 1, further comprising another detection unit, wherein the detection unit detects the electric potential of the output region in each of the plurality of cycles of the transfer signal generated by the transfer signal generating unit until the number of the cycles reaches the number of the plurality of light-emitting elements, and the another detection unit detects whether or not each of the plurality of light-emitting elements fails, on the basis of the electric potential of the output region detected by the detection unit.

4. The exposure device according to claim 1, comprising a plurality of light-emitting members each having the plurality of light-emitting elements and the plurality of switch elements, wherein a plurality of the light-emission signal supply units is provided respectively corresponding to the plurality of light-emitting members, and the detection unit detects the electric potential of the output region corresponding to each of the light-emitting members.

5. A light-emitting device comprising:

a plurality of light-emitting elements caused to emit light or not to emit light through a control using a light-emission signal;

a plurality of switch elements provided respectively corresponding to the plurality of light-emitting elements, the switch elements being sequentially turned on to set the respective light-emitting elements ready to emit light;

a transfer signal generating unit that generates a transfer signal for sequentially turning on the plurality of switch elements;

a light-emission signal supply unit that supplies the light-emission signal to the plurality of light-emitting elements; and a detection unit that causes the transfer signal generating unit to generate a transfer signal for each failure detection operation, the transfer signal having a plurality of cycles corresponding to transfer periods that detect disconnection in the wiring for the light-emitting elements and also having another cycle after the plurality of cycles corresponding to a transfer period that detects transfer trouble of the switch elements, the total number of cycles of the transfer signal for each failure detection operation being larger than the number of the plurality of light-emitting elements, and that detects an electric potential of an output region of the light-emission signal supply unit while making an output from the light-emission signal supply unit high impedance.

6. The light-emitting device according to claim 5, further comprising a judging unit, wherein the detection unit detects the electric potential of the output region in a cycle after as many cycles as the plurality of light-emitting elements are generated, the cycle being included in the plurality of cycles of the transfer signal generated by the transfer signal generating unit, and the judging unit judges whether or not the plurality of switch elements is normally turned on to perform a transfer operation, on the basis of the electric potential of the output region detected by the detection unit.

7. The light-emitting device according to claim 5, further comprising another detection unit, wherein the detection unit detects the electric potential of the output region in each of the plurality of cycles of the transfer signal generated by the transfer signal generating unit until the number of the cycles reaches the number of the plurality of light-emitting elements, and the another detection unit detects whether or not each of the plurality of light-emitting elements fails, on the basis of the electric potential of the output region detected by the detection unit.

8. The light-emitting device according to claim 5, wherein the light-emission signal supply unit includes:

an output circuit including a three-state output circuit that is to be set to any one of three states of a high level (H), a low level (L) and a high impedance (Hiz), the output circuit outputting the light-emission signal; and an input circuit to which an electric potential of an output region of the output circuit is inputted.

9. The light-emitting device according to claim 5, wherein the plurality of light-emitting elements and the plurality of switch elements each have a thyristor structure.

10. An image forming apparatus comprising:

an image carrier;

a charging device that charges the image carrier;

an exposure device that exposes the image carrier charged by the charging device to form an electrostatic latent image on the image carrier, the exposure device including:

a plurality of light-emitting elements caused to emit light or not to emit light through a control using a light-emission signal;

a plurality of switch elements provided respectively corresponding to the plurality of light-emitting elements, the switch elements being sequentially turned on to set the respective light-emitting elements ready to emit light;

a transfer signal generating unit that generates a transfer signal for sequentially turning on the plurality of switch elements;

a light-emission signal supply unit that supplies the light-emission signal to the plurality of light-emitting elements; and a detection unit that causes the transfer signal generating unit to generate a transfer signal for each failure detection operation, the transfer signal having a plurality of cycles corresponding to transfer periods that detect disconnection in the wiring for the light-emitting elements and also having another cycle after the plurality of cycles corresponding to a transfer period that detects transfer trouble of the switch elements, the total number of cycles of the transfer signal for each failure detection operation being larger than the number of the plurality of light-emitting elements, and that detects an electric potential of an output region of the light-emission signal supply unit while making an output from the light-emission signal supply unit high impedance;

a developing device that develops the electrostatic latent image formed on the image carrier to form an image; and a transfer device that transfers the images formed on the image carrier onto a recording medium.

11. A failure diagnosing method of an exposure device having a light output device that outputs light for exposing a charged image carrier and that includes a plurality of light-emitting elements caused to emit light or not to emit light through a control using a light-emission signal, a plurality of switch elements provided respectively corresponding to the plurality of light-emitting elements, the switch elements being sequentially turned on to set the respective light-emitting elements ready to emit light, a transfer signal generating unit that generates a transfer signal for sequentially turning on the plurality of switch elements, and a light-emission signal supply unit that supplies the light-emission signal to the plurality of light-emitting elements, and an optical member that focuses light outputted by the light output device onto the image carrier, the failure diagnosing method comprising:

causing the transfer signal generating unit to generate a transfer signal for each failure detection operation, the transfer signal having a plurality of cycles corresponding to transfer periods that detect disconnection in the wiring for the light-emitting elements and also having another cycle after the plurality of cycles corresponding to a transfer period that detects transfer trouble of the switch elements, the total number of cycles of the transfer signal for each failure detection operation being larger than the number of the plurality of light-emitting elements, and detecting an electric potential of an output region of the light-emission signal supply unit while making an output from the light-emission signal supply unit high impedance.

* * * * *